US008137027B2

(12) United States Patent
Nick et al.

(10) Patent No.: US 8,137,027 B2
(45) Date of Patent: Mar. 20, 2012

(54) SPRINKLER APPARATUS FOR DOSED SPRINKLING OF A BASE PLATE OF A VIBRATION APPARATUS FOR SOIL COMPACTION

(75) Inventors: Heinz Nick, Emmelshausen (DE); Kurt Hickmann, Braunshorn (DE); Thomas Weiler, Oberwesel (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 12/491,161

(22) Filed: Jun. 24, 2009

(65) Prior Publication Data

US 2009/0324333 A1 Dec. 31, 2009

(30) Foreign Application Priority Data

Jun. 24, 2008 (DE) ..... 10 2008 029 883

(51) Int. Cl.
*E01C 19/32* (2006.01)

(52) U.S. Cl. ..... 404/133.1

(58) Field of Classification Search ..... 404/129–133.1
See application file for complete search history.

(56) References Cited

U.S. PATENT DOCUMENTS

| | | | | |
|---|---|---|---|---|
| 2,578,080 | A | 12/1951 | Middlestadt | |
| 3,076,995 | A * | 2/1963 | Rabelow | 401/197 |
| 3,255,929 | A * | 6/1966 | De Haan | 222/613 |
| 3,453,058 | A * | 7/1969 | Bixel | 401/188 R |
| 3,782,845 | A * | 1/1974 | Briggs et al. | 404/133.1 |
| 4,421,435 | A * | 12/1983 | Zemke et al. | 404/113 |
| 5,085,537 | A | 2/1992 | Laditka | |
| 6,123,478 | A * | 9/2000 | Giles | 401/219 |
| 6,935,579 | B1 * | 8/2005 | Lindsey | 239/530 |
| 7,080,955 | B2 * | 7/2006 | Gregg | 404/89 |
| 7,213,997 | B1 * | 5/2007 | Joyner | 401/197 |
| 7,347,645 | B2 * | 3/2008 | Gregg | 404/93 |
| 2008/0003058 | A1 | 1/2008 | Persson et al. | |

FOREIGN PATENT DOCUMENTS

| | | | |
|---|---|---|---|
| DE | 29605664 | U1 | 8/1998 |
| DE | 102007026419 | A1 | 1/2008 |
| EP | 1043449 | A1 | 10/2000 |
| JP | 06193011 | A | 7/1994 |

* cited by examiner

*Primary Examiner* — Raymond Addie
(74) *Attorney, Agent, or Firm* — Baker & Hostetler LLP

(57) ABSTRACT

A sprinkler apparatus for dosed sprinkling of a base plate of a vibration apparatus for soil compaction is provided. The sprinkler apparatus comprises a fluid tank with a fluid outlet, a valve for controlling the fluid release by the fluid outlet, and a control lever for actuating the valve. Preferably, the control lever concerns a rocking or swivel lever which is fastened to the upper region of the fluid tank. The lever allows a simple and secure dosing of the fluid release in the sprinkler apparatus.

17 Claims, 10 Drawing Sheets

SPRINKLER APPARATUS FOR DOSED SPRINKLING OF A BASE PLATE OF A VIBRATION APPARATUS FOR SOIL COMPACTION

CROSS-REFERENCE TO RELATED APPLICATIONS

This application claims priority to foreign Patent Application DE 10 2008 029883.2, filed on Jun. 24, 2008, the disclosure of which is incorporated herein by reference in its entirety.

FIELD OF THE INVENTION

The invention relates to a sprinkler apparatus for dosed sprinkling of a base plate of a vibration apparatus for soil compaction such as a vibrating plate for example. According to a further aspect of the invention, it relates to a vibration apparatus for soil compaction with a sprinkler apparatus for dosed sprinkling of a base plate of the vibration apparatus.

BACKGROUND OF THE INVENTION

Sprinkler apparatuses for sprinkling a base plate of a vibration apparatus for soil compaction such as a vibrating plate for example are already known from the state of the art. Sprinkling during a compaction process is necessary in order to prevent the adherence of material to be compacted such as asphalt to a base plate for example. Water is mostly used as the sprinkling fluid. The use of other fluids and additives to hydrous solutions are known however.

Several known devices include a vibrating plate with a sprinkler apparatus and a removable water tank. Water flows from the tank to a lower section when a shut-off valve which is also arranged below is opened. No continuous adjustment of the water quantity is provided. The water flows into a nozzle tube, from which the water is sprayed directly onto the floor in front of the base plate of the vibration apparatus.

Another known sprinkler device principally allows a dosed setting of the water quantity which is used for sprinkling. For this purpose, a turning knob is provided at the top of the water tank. The water runs into a specially arranged groove via an opening in the bottom region of the water tank, which groove is attached to the base plate of the vibration apparatus. When more water flows into the groove than it can handle, the groove overflows and thus sprinkles in this way an upwardly bent area of the base plate of the vibration apparatus.

Although the latter sprinkler device represents a sprinkler apparatus which is more user friendly as a result of the turning knob arranged at the top of the water tank and it is principally possible to dose the sprinkling process by turning the turning knob, it is difficult with this turning knob to recognize the respective current setting at a glance even from far away. An inadvertent overtwisting of the turning knob also does not appear to be impossible. Although a user of the turning knob will feel the various latching positions when turning the knob, the sensing of these latching positions is often made more difficult by wearing working gloves and by the vibrations occurring during the operation of the vibration apparatus.

SUMMARY OF THE INVENTION

Embodiments of the present invention overcome the mentioned disadvantages of the state of the art, especially by providing an improved sprinkler apparatus for dosed sprinkling of a base plate of a vibration apparatus for soil compaction which enables a simple and secure setting of the dosing.

According to a first aspect of the invention, it relates to a sprinkler apparatus for dosed sprinkling of a base plate of a vibration apparatus for soil compaction with a fluid tank with a fluid outlet, a valve for controlling the fluid release by the fluid outlet, and a control lever for actuating the valve. The vibration apparatus may concern a so-called vibrating plate for example. In accordance with the invention, sprinkling occurs in a dosed manner, which means the valve can be brought by the control lever to at least two different positions in which fluid is released. In accordance with the invention, the actuation of the valve occurs by means of the control lever. Such a control lever can also be operated very well through working gloves. Moreover, the position of a lever is visually easy to perceive. Different types of control levers can be considered as control lever. In particular, a control lever can be concerned which is actuated by tipping the lever. It can further concern a control lever which is not tipped, but twisted instead. It is also possible to combine the two forms of operation with each other. It is further possible to release the control lever itself prior to actuation and to lock the same again after actuation, e.g. by pulling the lever out of a latched position, actuating the lever according to one of the possibilities described above, and subsequently pressing back the lever to a further or the same position. The control lever per se can be provided with an integral arrangement or be made from several parts. It can be arranged linearly, curved, angled or as a special lever. In the case of a swivel lever arranged in a bent manner, it can be arranged in a rigid way or alternatively with a joint in the area of the angle.

Preferably, the fluid outlet of the fluid tank is located in the bottom region of the fluid tank or in the floor of the fluid tank. This allows letting the fluid flow out of the fluid outlet merely through gravitational action when the valve is opened. Moreover, it is possible to empty the fluid tank nearly completely.

The control lever for actuating the valve can be located in the direct vicinity of the valve. According to a preferred embodiment, the control lever is provided outside of the fluid tank in the upper region of the fluid tank. This ensures better accessibility of the control lever when the sprinkler apparatus in accordance with the invention is fixed to a vibration apparatus. It is not necessary in this case to release a guide handle of the vibration apparatus with both hands. The control lever can be operated for example by throwing the lever in various directions or by twisting the same. The release of fluid varies according to the position of the control lever. It is alternatively also possible to successively move the control lever up and down, with the upward and downward movement leading to another position of the valve. However, the current setting of the fluid release is not easily recognizable from far away in the latter case.

According to a preferred embodiment of the invention, the valve comprises a conical nipple which is connected with the control lever via an actuating element, so that the position of the conical nipple is changed when the control lever is actuated. Preferably, the actuating element is provided with a longitudinally extended configuration. The actuating element may concern an actuating rod or an actuating cable. Preferably, a straight rod is concerned in the case of an actuating rod, preferably made of metal. It can also have a different shape and comprise bends for example. Preferably, a steel cable is concerned in the case of an actuating cable. It is principally also possible to combine an actuating rod and an actuating cable into one actuating element. Preferably, the position of the conical nipple is displaced in the axial direction of the actuating element, so that the opening size for the fluid outlet is controlled on the basis of the geometrical properties of the sealing element in the form of the conical nipple. It is important that the coupling of the movement of the control lever to a change in position of the conical nipple is performed, with which it is possible to set the dosing of the fluid outlet. Providing an actuating element ensures especially that a larger distance between the valve on the one hand and the position of the control lever on the other hand is ensured, so that the control lever can be attached to the upper region of the fluid tank.

According to a further preferred embodiment, the control lever is an eccentric tension lever which rests on a bracket, with a tensioning means being provided in an area of the actuating element, especially an actuating rod, beneath the bracket, which tensioning means is tensioned or relaxed upon actuating the eccentric tension lever. Eccentric tension levers are known per se in the state of the art in another context. They advantageously comprise a handle for gripping and throwing the lever as well as a rotary body. Said rotary body is not arranged in a rotationally symmetrical way. Instead, the surface of the rotary body has different distances to the rotational axis with respect to a rotation about the rotational axis of the rotary body. As a result, an at least partly eccentric movement of the circumferential surface of the rotary body occurs about the rotational axis. A bracket shall be understood as being a component which is provided in a spatially fixed manner relative to the fluid outlet. It is possible to attach the bracket as a separate component at the top of the fluid tank. The bracket can also be arranged integrally with the water tank. As already mentioned, one area of the actuating element comprises a tensioning means. It can concern the upper region of the actuating element which is preferably located directly beneath the bracket. It is also possible that the tensioning means is provided in a lower region of the actuating element. A spring or a rubber-elastic component can be used as a tensioning means for example. When the eccentric tension lever is thrown, which means that the rotary body of the eccentric tension lever is made to rotate about the rotational axis, the distance changes between the bearing surface of the bracket and the rotational axis. When this distance increases, the tensioning means is compressed against a resistance beneath the bracket and the actuating element moves in its entirety, preferably in the axial direction of the actuating element, away from the fluid outlet. The conical nipple which is fastened to the actuating element also changes its position accordingly and releases a part of the fluid outlet. When the eccentric tension lever is brought to another position however in which the distance between the rotational axis and the bearing point of the rotary body on the bracket decreases, the actuating element with the conical nipple is further away from the bracket and is able to seal the fluid outlet more strongly, during which the tensioning element is extended. Preferably, the tensioning means in a fully relaxed state when the valve is completely closed, so that when the eccentric tension lever is thrown and the valve is opened a force needs to be applied to compress the tensioning means.

According to a preferred embodiment, the rotary body of the eccentric tension lever comprises a plurality of different surface regions which can rest on the bracket. These various surface regions shall be understood as surface regions which differ with respect to their distance from the rotational axis. Depending on which of these surface regions rests on the bracket, a respective position of the valve is obtained and thus a respective dosing concerning the fluid release.

According to a preferred embodiment, the contact area of the bracket is planar with the eccentric tension lever and at least parts of the various surface regions of the rotary body are also provided with a planar arrangement. As a result of the planar arrangement, an especially favorable and secure setting of a certain dosing is ensured. It is preferably so that the various planar surface regions are not adjacent to one another via sharp projections of edges. It is rather preferable that such edges are rounded off, which means that there is a gradual transition between the various surface regions with respect to each other. This enables a simpler operation of the eccentric tension lever and moreover prevents undesirable rubbed-off parts on the eccentric tension lever or the bracket.

According to a preferred embodiment, the operating lever is arranged as a swivel lever which rests on a bracket with at least two different latching positions, in which the swivel lever can be brought by turning, so that depending on the position of the swivel lever in one of the latching positions the position of the conical nipple can be changed through the actuating element connected with the swivel lever. A bracket shall be understood in this respect as a component which is provided in a spatially fixed manner relative to the fluid outlet. It is possible to attach the bracket as a separate component at the top of the fluid tank, but the bracket can also be arranged integrally with the water tank. Different technical possibilities for realization can be used for forming latching positions. It is possible for example to fix the swivel lever in the latching positions by clicking, clamping, lowering or sliding in the same. According to an especially preferred embodiment of the invention, the latching positions in the form of recesses in the bracket are arranged in such a way that the swivel lever needs to be lifted for twisting to another position. If the bracket is planar for example, its surface can comprise different recesses or depressions in different rotary positions of the swivel lever in which the swivel lever can engage by pressing the same into them or sliding into them. In this way, further twisting of the swivel lever is excluded. Preferably, the recesses of the console are provided with a differently deep arrangement. If the swivel lever is rigidly connected with the actuating element, the actuating element is also brought to a changed position when the swivel lever is lifted, i.e. by lifting the swivel lever from the bracket. It is especially possible that the actuating element is displaced in the axial direction, which again has an influence on the position of the conical nipple. When the swivel lever is now brought to different latching positions, especially to latching positions in the form of recesses that are provided with a differently deep arrangement, the axial position of the actuating elements changes according to the position of swivel lever which is rigidly connected with the actuating element. In this way, the axial position of the actuating element and thus the position of the conical nipple on the valve can be controlled via the position of the swivel lever in one of the latching positions.

According to a preferred embodiment of the invention, twisting of the swivel lever occurs about an axis of the actuating element. It is possible that said rotary movement is superimposed by another movement, e.g. a movement of the swivel lever in the axial direction of the actuating element.

According to a preferred embodiment of the invention, a connection area between the latching steps comprises a beveled portion. This beveled portion ensures that the swivel lever can be moved in a guided manner from one latching position to another latching position. In particular, a movement from one latching position to another latching position can be facilitated or obstructed by the direction of the beveled portion.

When the latching positions are provided as recesses, they can be provided with an arrangement of different depths. It is alternatively also possible that the recesses themselves are each provided with the same depth (relating to the bracket surface), but that the surface of the bracket is not provided with a planar configuration. As a result, the positioning of the swivel lever in the different recesses can lead to different axial positioning of the actuating element in case of coupling the swivel lever to the actuating element. It is further possible that the bracket is provided with a planar configuration, but that the normal line of this plane is tilted against the axial direction of the actuating element, which leads to the same effect.

It is preferably so that when a swivel lever is used as a control lever a tensioning means is provided which keeps the conical nipple under a pretension.

The number of latching positions can vary. There can be two, three or more latching positions. It is preferably so that the valve is closed in one of the latching positions and none of the fluid can emerge from the sprinkler apparatus. It is preferably further so that in a further latching position the valve is completely opened. Any desired number of latching positions can be provided in between in order to open the valve to a certain extent, e.g. in order to half open the valve.

According to a preferred embodiment, the sprinkler apparatus comprises a valve insert which can be inserted from the outside into the fluid tank. This enables a simple production both of the fluid tank as well as the valve insert, and also simple assembly.

According to a further preferred embodiment, the sprinkler apparatus further comprises a sprinkler pipe which can be pressed into the valve insert. Simple production of the sprinkler apparatus is thus enabled. The sprinkler apparatus can also be assembled in a simple way and any defective parts such as valve insert and/or sprinkler pipe can be exchanged modularly.

According to a preferred embodiment, the sprinkler apparatus can be fastened detachably to a vibration apparatus. This enables easier filling of the fluid tank for example.

According to a preferred embodiment, the fluid tank of the sprinkler apparatus comprises a depression for receiving a motor hoop guard of a vibration apparatus, so that the sprinkler apparatus can be placed on the vibration apparatus. Preferably, said depression is located on the bottom side of the fluid tank. The depression preferably extends over the entire bottom side of the fluid tank, which is not mandatory however. Instead, the depression can be provided merely at some points of the fluid tank. The provision of a depression for receiving a motor hoop guard allows attaching the fluid tank in a very simple manner to a vibration apparatus.

It is understood that the embodiments of the sprinkler apparatus as described above can be combined with each other either fully or in part.

According to a further aspect of the invention, it relates to a vibration apparatus for soil compaction which comprises an exciter for generating vibrations, a base plate which can be made to vibrate by the exciter and a sprinkler apparatus as described above. The sprinkler apparatus may comprise all of the features described above either individually or in combination. The vibration apparatus concerns a vibrating plate for example. A conventional exciter or motor can be used for generating the vibrations.

BRIEF DESCRIPTION OF THE DRAWINGS

The invention will be understood even better by reference to the enclosed drawings.

DETAILED DESCRIPTION

Figure 1:
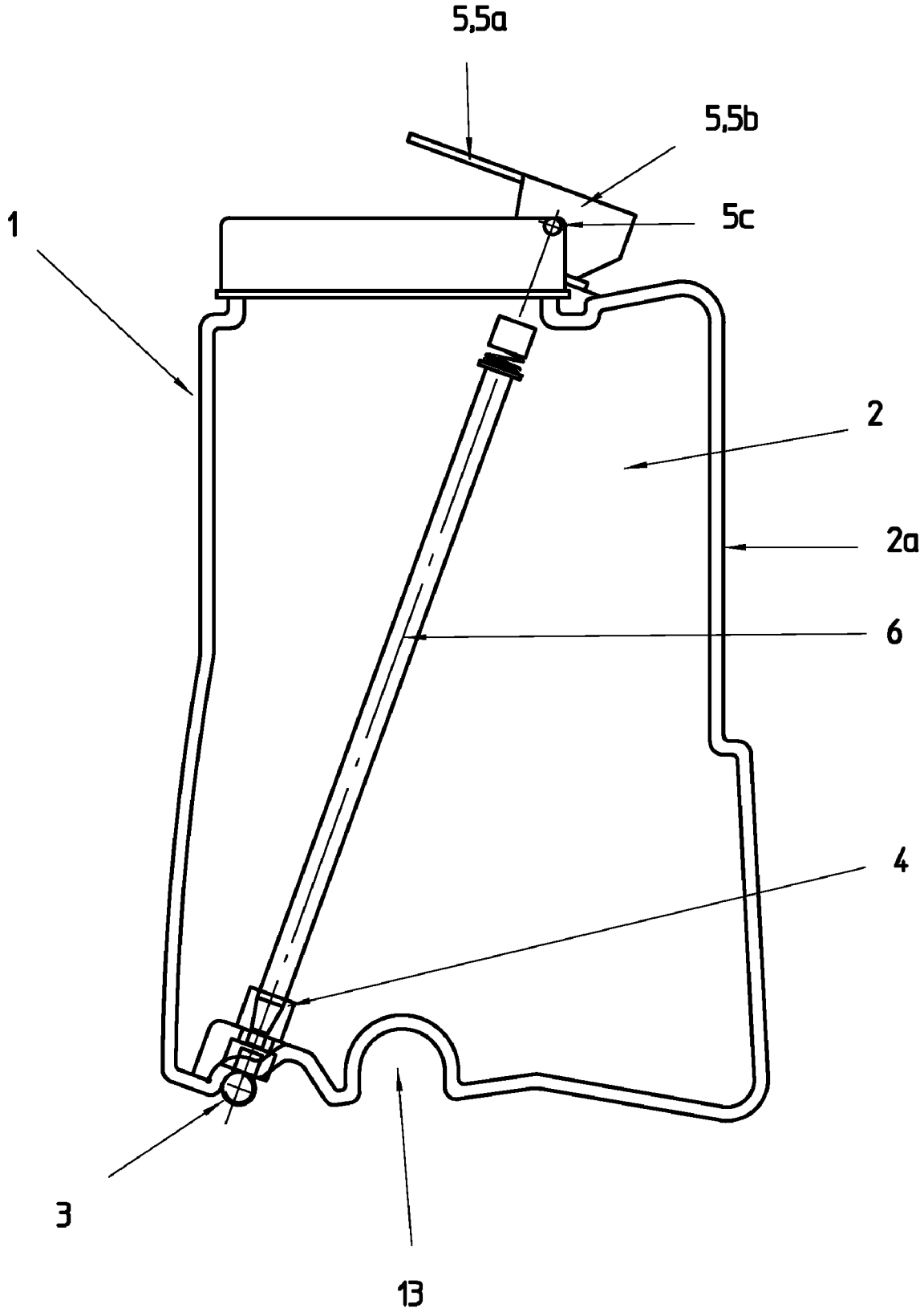
FIG. 1 shows a principal diagram of a sprinkler apparatus, in accordance with a first embodiment of the invention, with a control lever in the form of a rocking lever (lateral sectional view through the apparatus).

The invention will now be described with reference to the drawing figures, in which like reference numerals refer to like parts throughout.

FIG. 1 shows a lateral sectional view through an embodiment of a sprinkler apparatus in accordance with the invention in the form of a principal diagram. Sprinkler apparatus 1 comprises a fluid tank 2 with a fluid outlet 3, a valve 4 for controlling the fluid release through the fluid outlet 3 and a control lever 5 for actuating the valve 4. The fluid tank is filled with water in the present case. The capacity of the water tank is approximately 11 and 15 liters. Water tank 2 can be fastened in a detachable manner to a vibration apparatus. The control lever concerns an eccentric tension lever 5. It is located on the outside in the upper area of the water tank 2. The eccentric tension lever 5 is connected with the valve 4 via an actuating rod 6 which extends in the present case in an oblique manner through the fluid tank 2. The fluid outlet 3 is located in the bottom area of the water tank 2, which in the present case is close to a boundary position of the floor of the water tank 2. When valve 4 is actuated by actuating the eccentric tension lever 5, water passes through the fluid outlet 3 solely through the gravitational effect. A depression 13 is provided in the bottom area of the water tank which extends in the present example along the entire floor of the water tank 2. This depression 13 is used to fasten the sprinkler apparatus 1 in a simple manner to a vibration apparatus 20. Depression 13 is used for receiving a motor hoop guard of a vibration apparatus for example.

Figure 2:
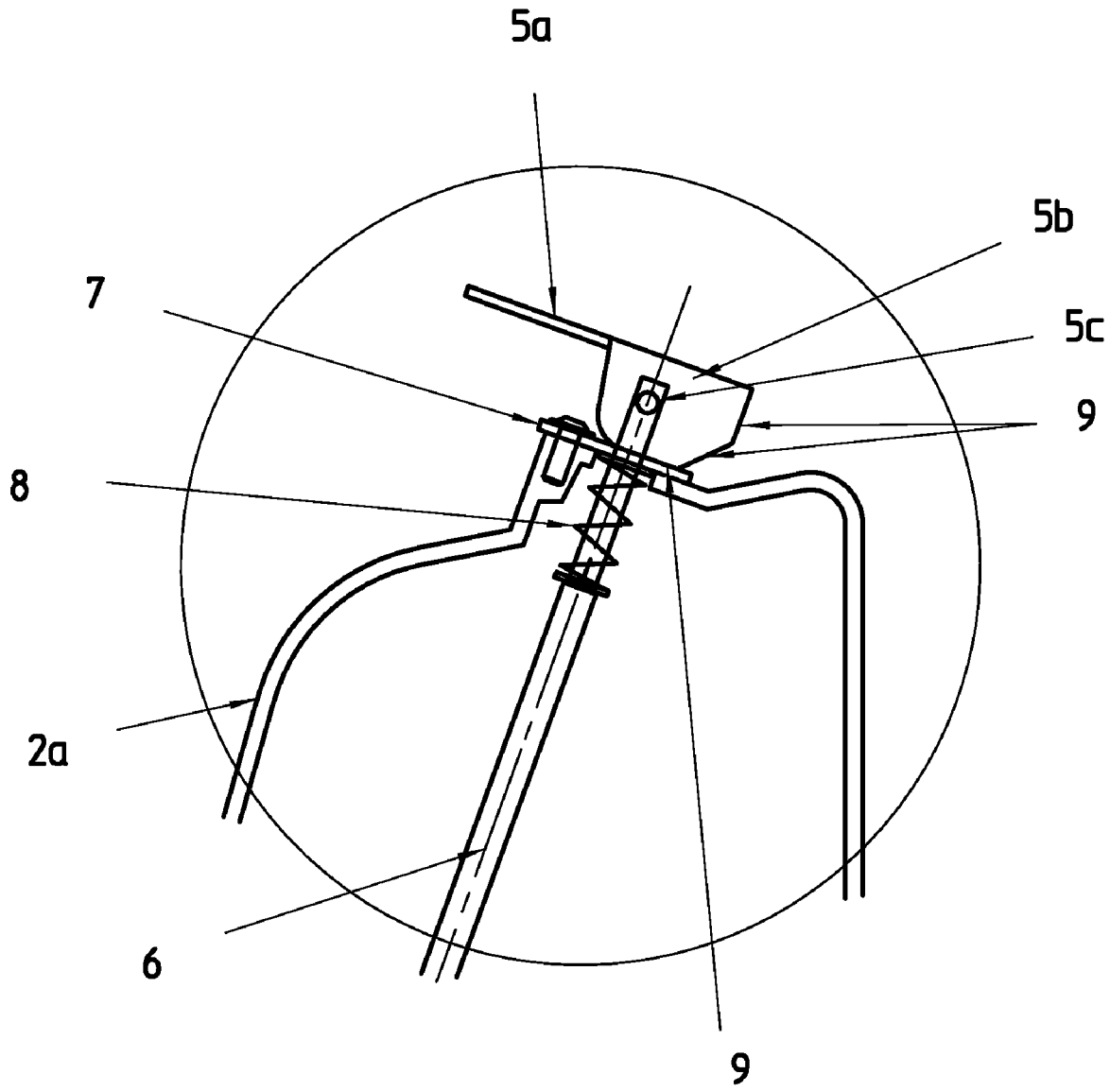
FIG. 2 shows an enlarged area of FIG. 1 in the area of the actuating lever.

FIG. 2 shows an enlarged area of FIG. 1, namely in the region of the eccentric tension lever 5. The eccentric tension lever 5 is composed of a handle 5*a* and a rotary body 5*b*. The eccentric tension lever or the rotary body 5 respectively are held in a rotatable manner about the rotational axis 5*c*, that faces into the plane of the drawing. Rotary body 5*b* comprises different regions 9 in the illustrated example. These areas 9 are provided at least partly with a planar configuration. They each have a certain distance to the rotational axis 5*c*. The rotary body 5 lies on a bracket 7. It is located at the top on water tank 2. In the present example, the bracket is stationary with respect to the water tank 2 and also stationary with respect to the fluid outlet 3. The eccentric tension lever 5 is connected to an actuating rod 6 in the area of the rotational axis 5*c* of the eccentric tension lever 5. An area of the actuating rod is provided with a pressure spring 8 beneath the bracket 7, which spring acts as a tensioning means. The eccentric tension lever is now actuated by an actuation of handle 5*a*. The actuating rod is displaced in the axial direction of the actuating rod as a result of eccentricity (which is only partly present in the present example and is also not entirely required) of the rotary body. When the distance between bracket and rotational axis 5*c* increases, the actuating rod 6 is moved away from the fluid outlet 3 and the pressure spring 8 is compressed. When the distance between the surface of bracket 7 and the rotational axis 5*c* decreases, pressure spring 8 expands and the actuating rod 6 moves in the axial direction towards the fluid outlet 3. Preferably, the pressure spring is in a completely relaxed state when the valve is completely closed, to that when the eccentric tension lever is thrown and the valve is opened a force needs to be exerted for compressing the pressure spring.

Figure 3:
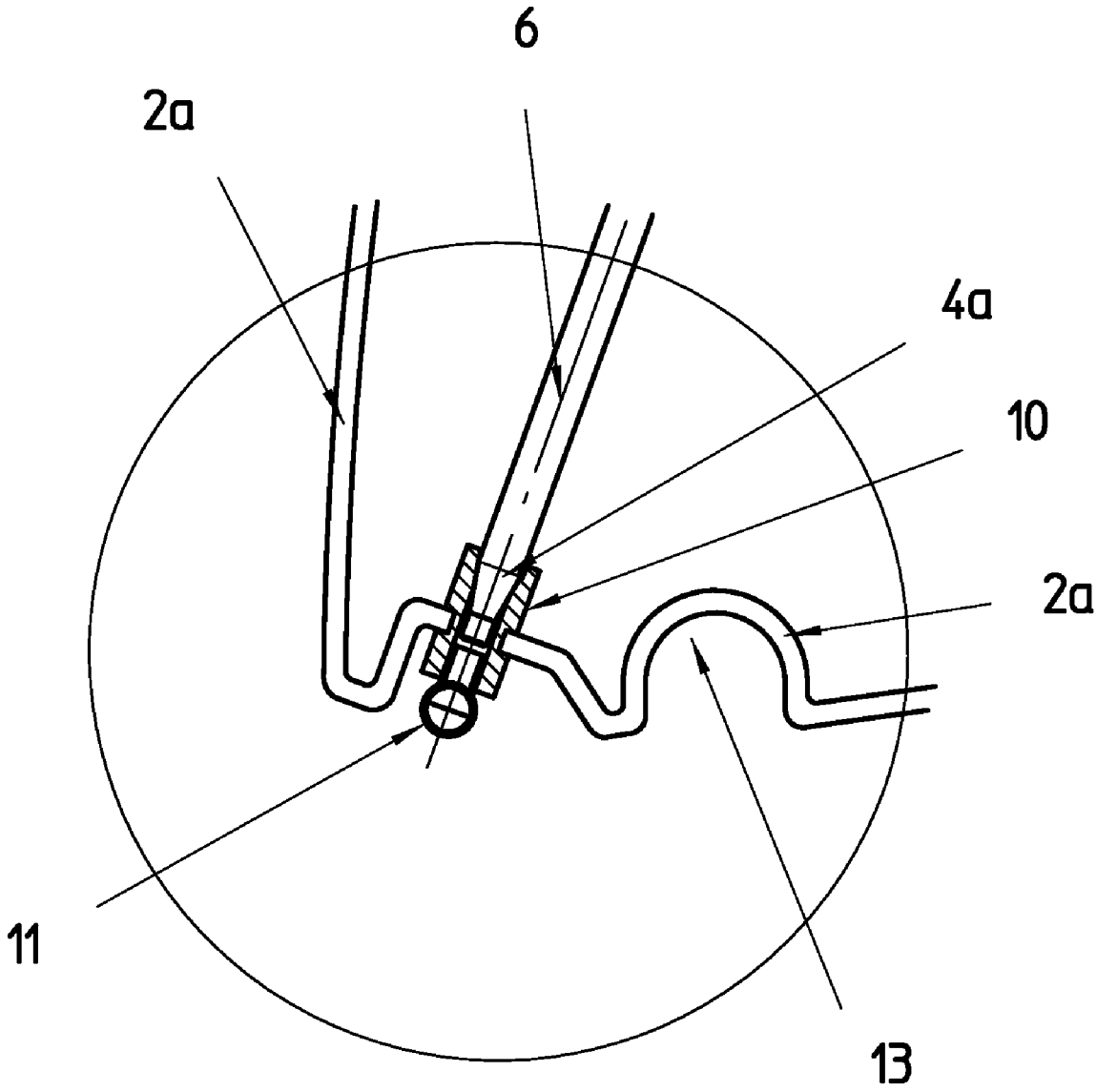
FIG. 3 shows an enlarged area of FIG. 1 in the area of the fluid outlet.

FIG. 3 shows an enlarged area of FIG. 1 in the region of the fluid outlet 3. This detailed view shows that the actuating rod 6 opens into a conical nipple 4*a*. Said conical nipple 4*a* is located in a valve insert 10, in the other end of which a sprinkler tube 11 is inserted. When the actuating rod 6 moves as a result of an actuation of the eccentric tension lever 5 as described in connection with FIG. 2, the axial displacement of the actuating rod 6 is accompanied by an axial movement of the conical nipple 4*a*. When the conical nipple 4*a* is displaced in the axial direction towards the rotational axis 5*c* (upwardly inclined in FIG. 3), the conical nipple 4*a* is partly pulled out of the valve insert 10 and the fluid outlet 3 is now no longer completely sealed by the conical nipple 4*a*. The farther the conical nipple 4*a* is pulled out of the valve insert 10, the more liquid can flow out of the fluid outlet 3 or the sprinkler tube 11. As a result of the respective position of the eccentric tension lever 5, the dosing of the fluid outlet can thus be adjusted in steps. Moreover, depression 13 in the area of the wall 2*a* of the fluid tank 2 can be recognized very well in FIG. 3.

Figure 4:
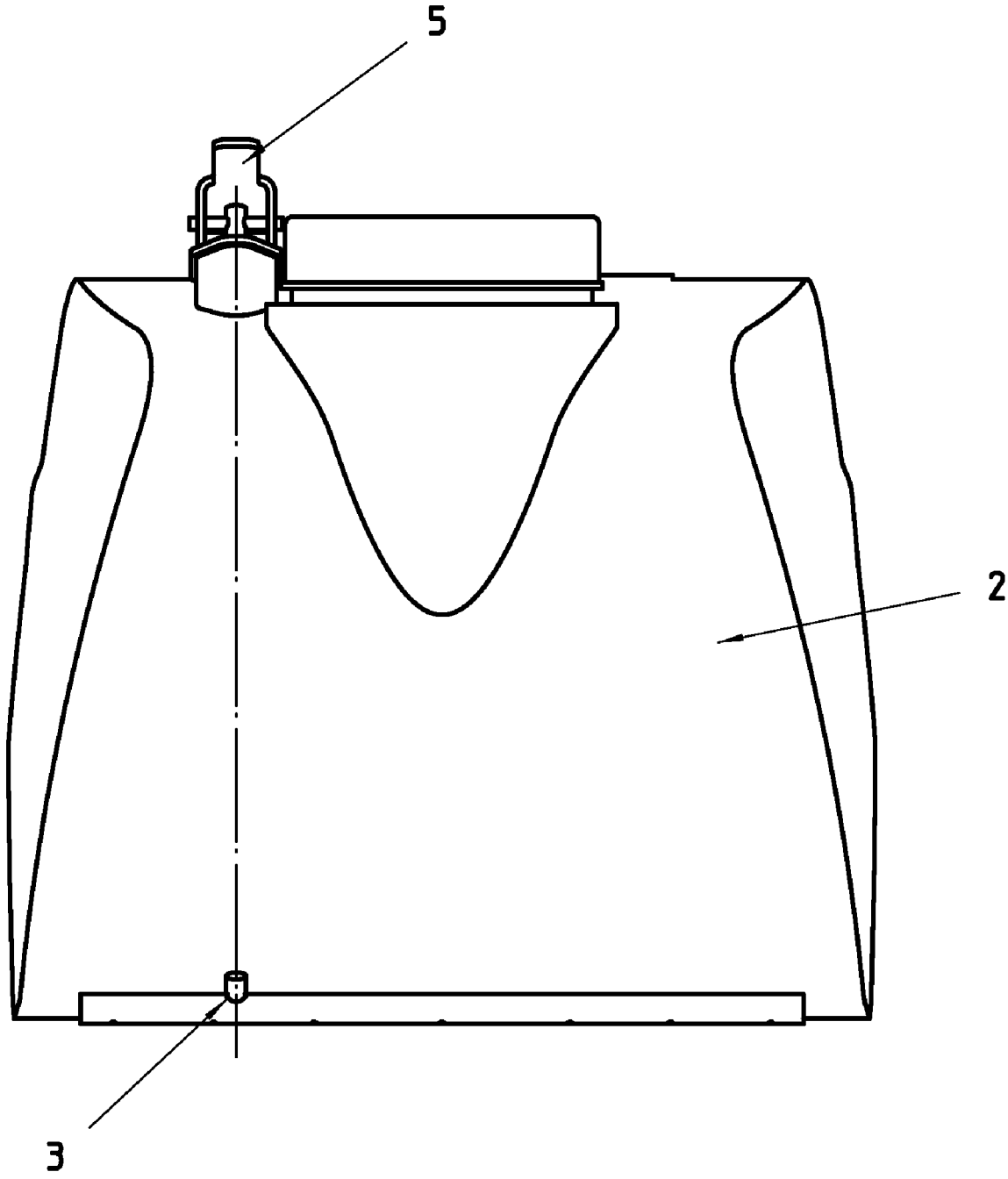
FIG. 4 shows a front view of the fluid tank of FIG. 1.

FIG. 4 shows a front view of the fluid or water tank 2. It shows the fluid outlet 3 and the eccentric tension lever 5.

Figure 5:
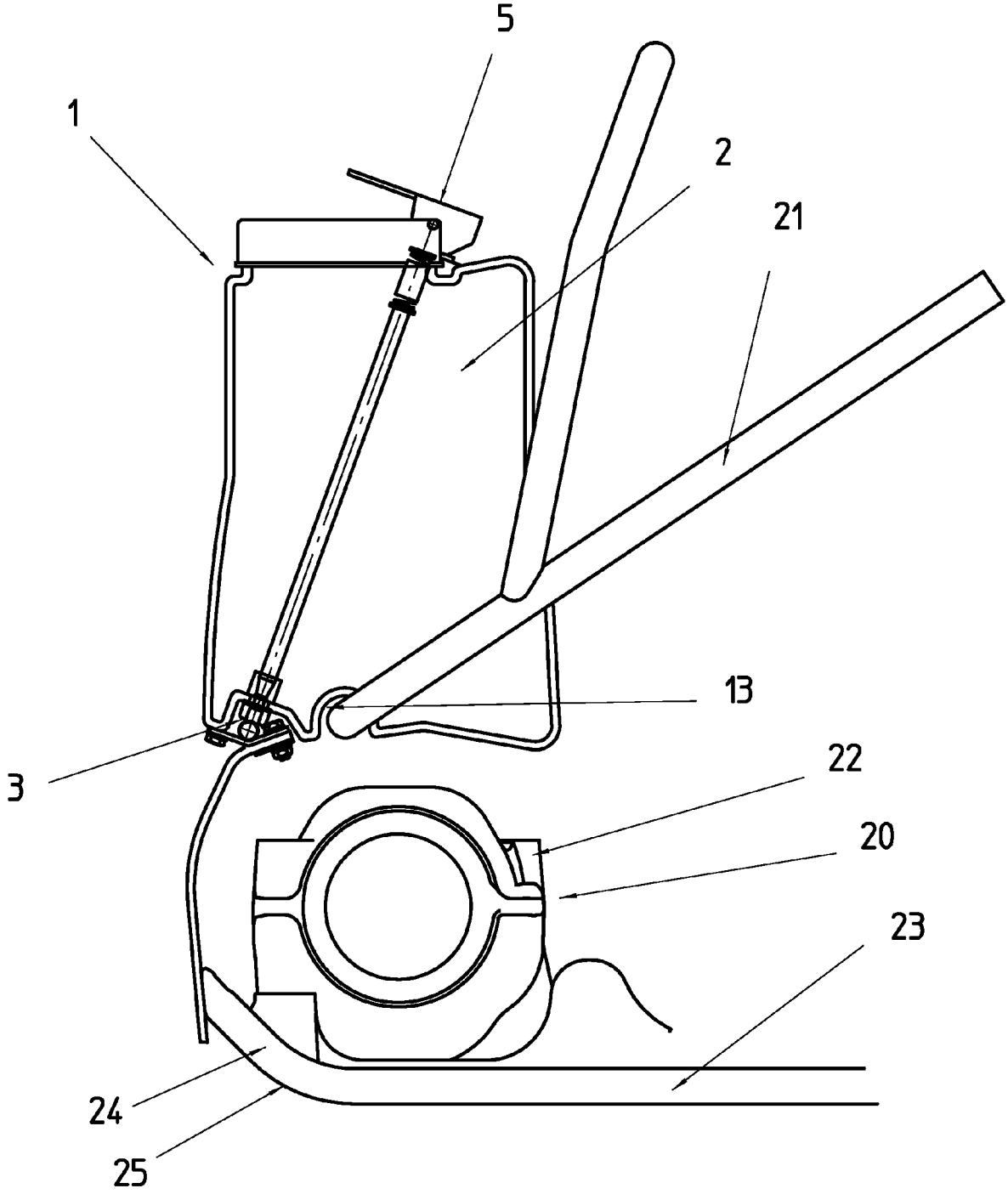
FIG. 5 shows a vibration apparatus for soil compaction with a sprinkler apparatus fastened thereto.

FIG. 5 shows a vibration apparatus for soil compaction with a sprinkler apparatus 1, as shown in FIGS. 1 to 4. The sprinkler apparatus 1 is connected via the water tank 2 with the vibration apparatus 20. The depression 13 of water tank 2 lies on the motor hoop guard 21 of the vibration apparatus 20. The sprinkler apparatus can thus be placed on the vibration apparatus in a simple manner. The vibration apparatus 20 comprises an exciter for generating vibrations (cf. exciter housing 22) which can make the base plate 23 vibrate. These vibrations lead to a compaction of the soil. Base plate 23 is provided in a front region (front with reference to a direction of movement of the vibration apparatus in the process of soil compaction) with an inclined section 24 which is bent upwardly away from the floor. When fluid emerges from the fluid outlet 3, it can sprinkle the base plate 23 or the floor in front of the same. Moreover, sprinkling can occur in a dosed manner.

Figure 6:
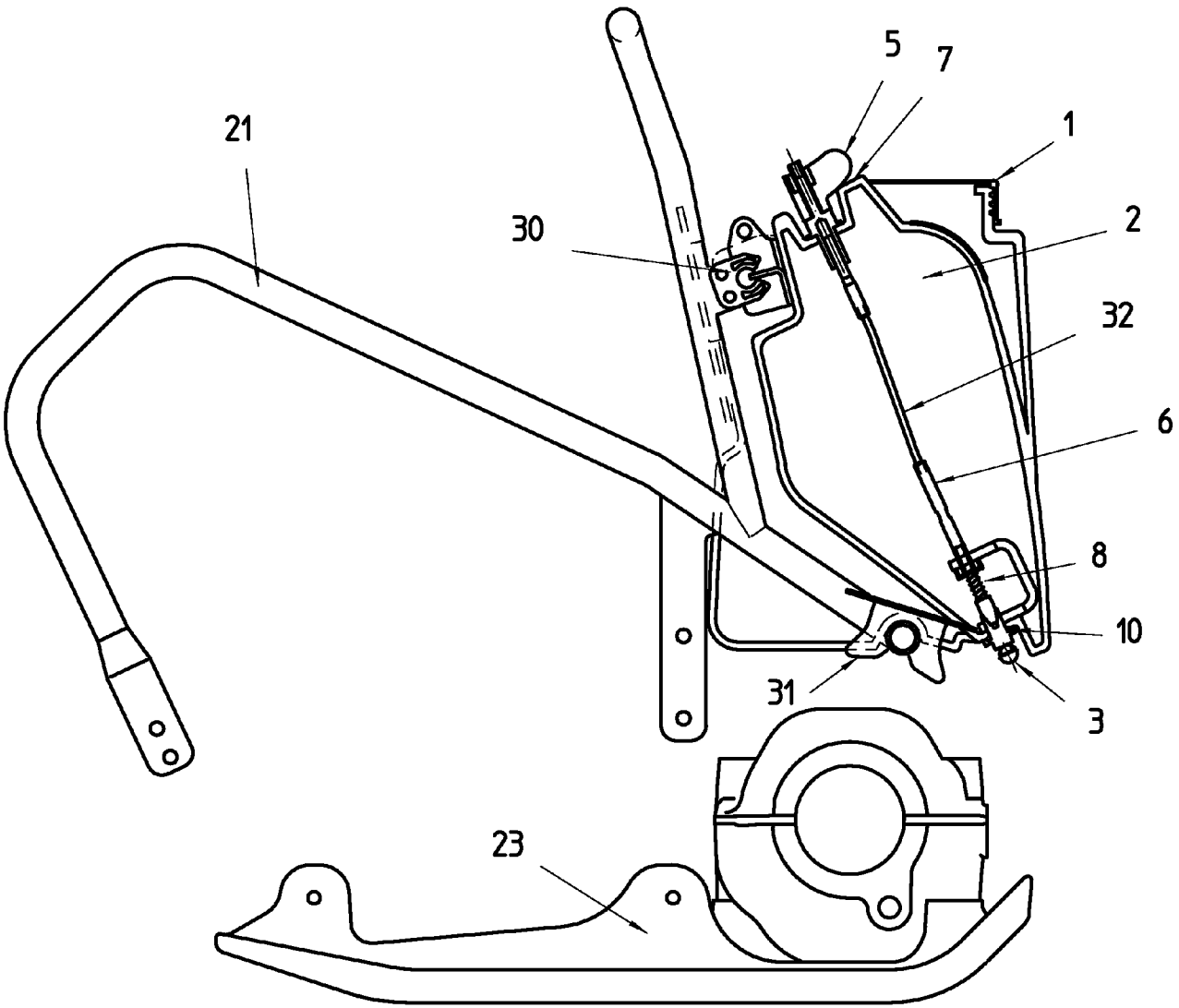
FIG. 6 shows a further embodiment of the invention with a control lever in the form of a swivel lever.

FIG. 6 shows a further embodiment of the invention with a control lever in the form of a swivel lever 5 in a side view. Swivel lever 5 rests on a bracket 7 of a fluid tank 2 and can be brought to different latching positions while resting on the bracket. The sprinkling apparatus 1 is fastened by means of a plastic clamping element 30 to a motor hoop guard 21. This allows arranging the sprinkling apparatus in a detachable configuration and fastening the same without any special tools to a vibration apparatus.

Figure 7:
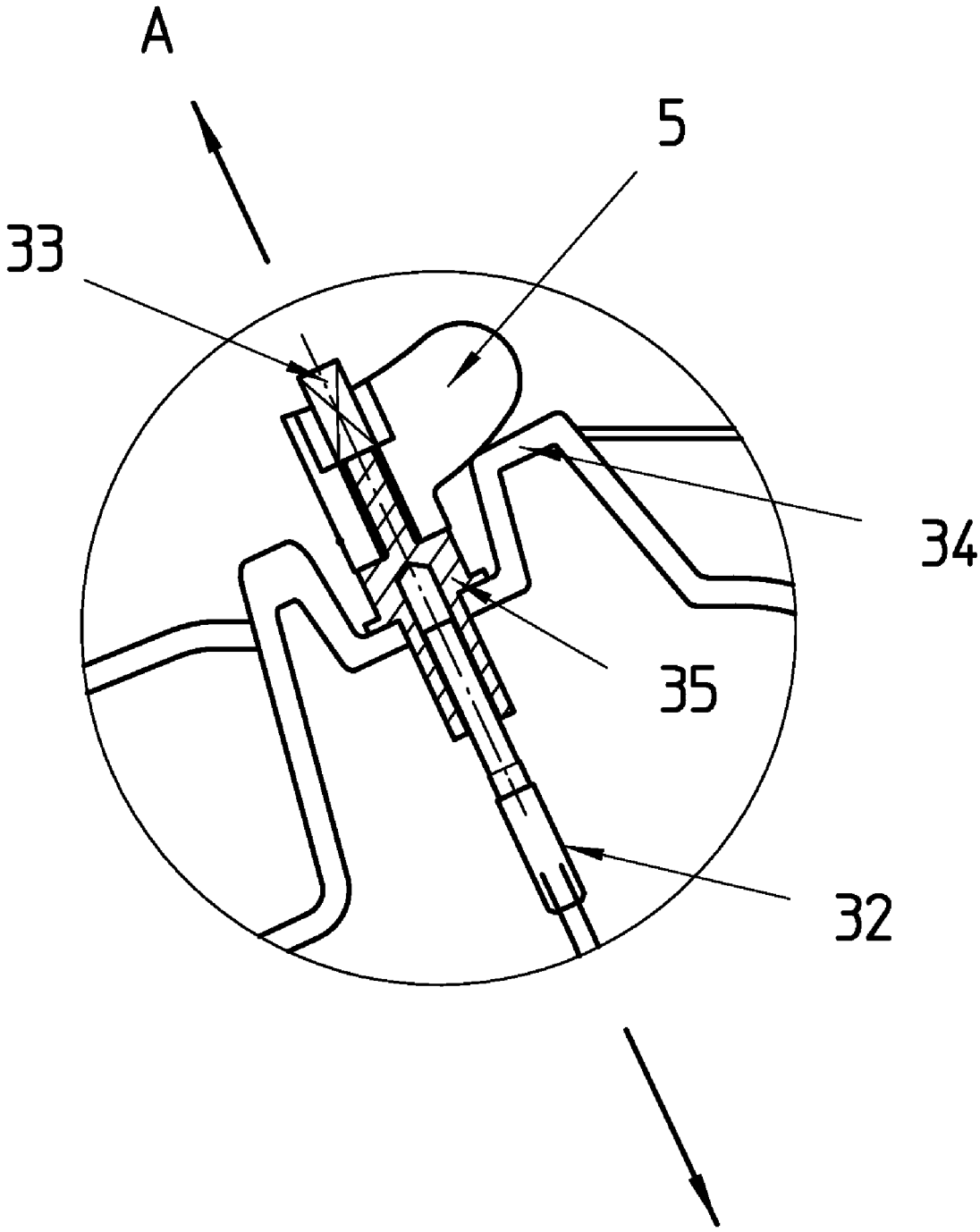
FIG. 7 shows an enlarged view of the swivel lever of FIG. 6 in a sectional view.

FIG. 7 shows an enlarged view of the swivel lever of FIG. 6 also in a side view. The actuating lever 5 is shown which is disposed in a specific latching position 34 which is shown in the bracket 7. In the illustrated embodiment, the bracket is arranged integrally with the contour of the tank. A square 33 is used for securing the operating lever 5. An adjusting sleeve 35 with an inside thread M8 and hexagon insert bit is provided beneath the actuating lever 5. A special steel cable 32 with an external thread M8 is connected with the same. Before the control lever 5 can be actuated, it needs to be lifted along the direction A. Then the control lever 5 can be twisted laterally and brought to another latching position.

Figure 8:
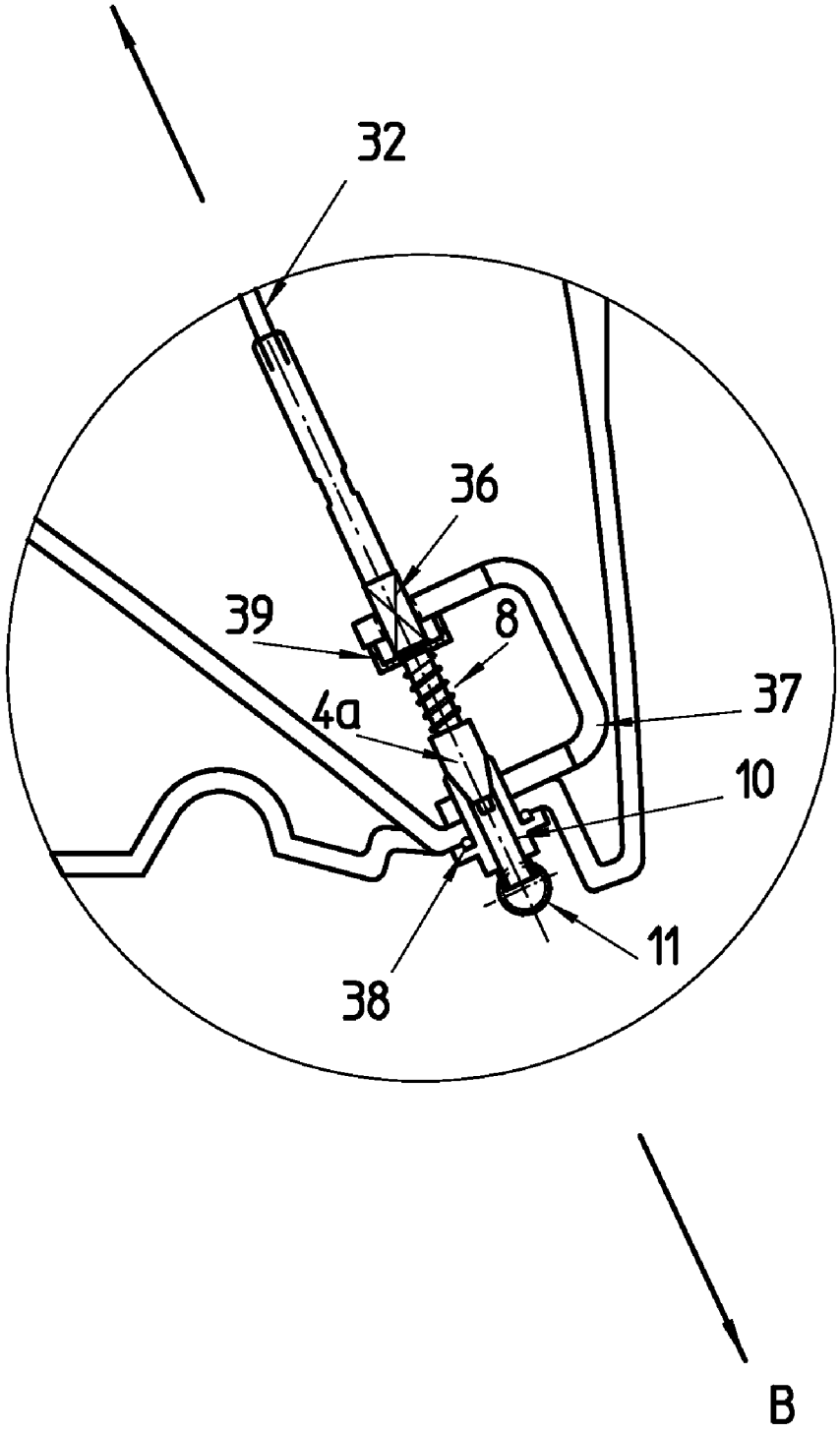
FIG. 8 shows an enlarged view of the valve area of FIG. 6 in a sectional view.

FIG. 8 shows an enlarged view of the valve area of FIG. 6 also in a side view. It shows the conical nipple 4*a* in the area of the valve, through the position of which the sealing state can be set in the axial direction B and the delivery of the fluid quantity can be dosed. A pressure spring 8 is located adjacent to the conical nipple 4*a* which rests on the adjusting sleeve 39 which always holds the pressure spring 8 under pretension and prevents that the conical nipple 4*a* will jump out of the opening in which it is inserted. A square 36 is used for fixing the steel cable 32 and the slide with the cone or conical nipple 4*a*. A bracket 37 is supported against twisting on an inside wall of the tank. An O-ring seal 38 is provided as a sealing against the tank wall. Furthermore, a valve insert 10 with a cone and an outlet opening and a sprinkler tube 11 are shown in FIG. 8, into which the outlet 3 of the valve 4 protrudes.

Figure 9:
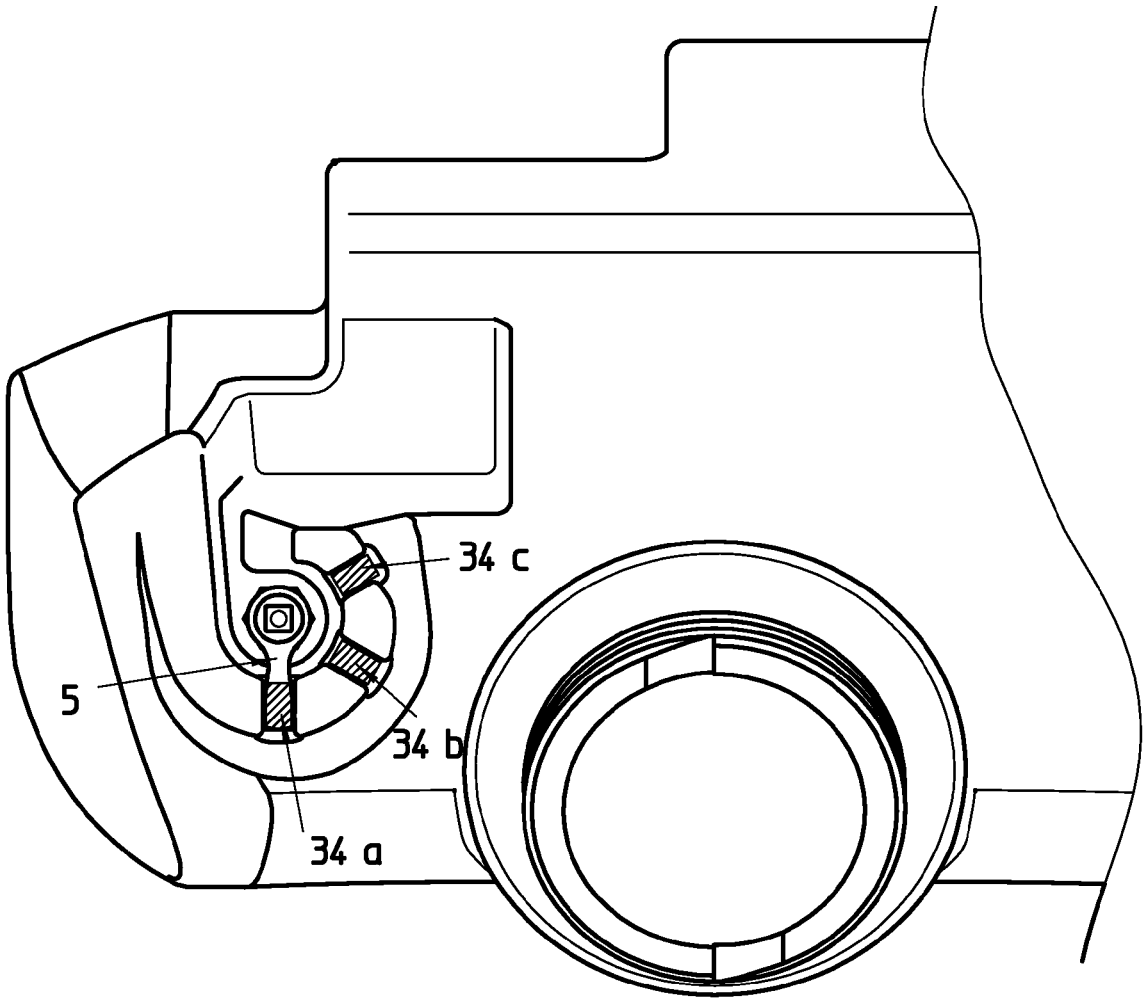
FIG. 9 shows a top view of the swivel lever and different latching positions for the swivel lever in a bracket.
Figure 10:
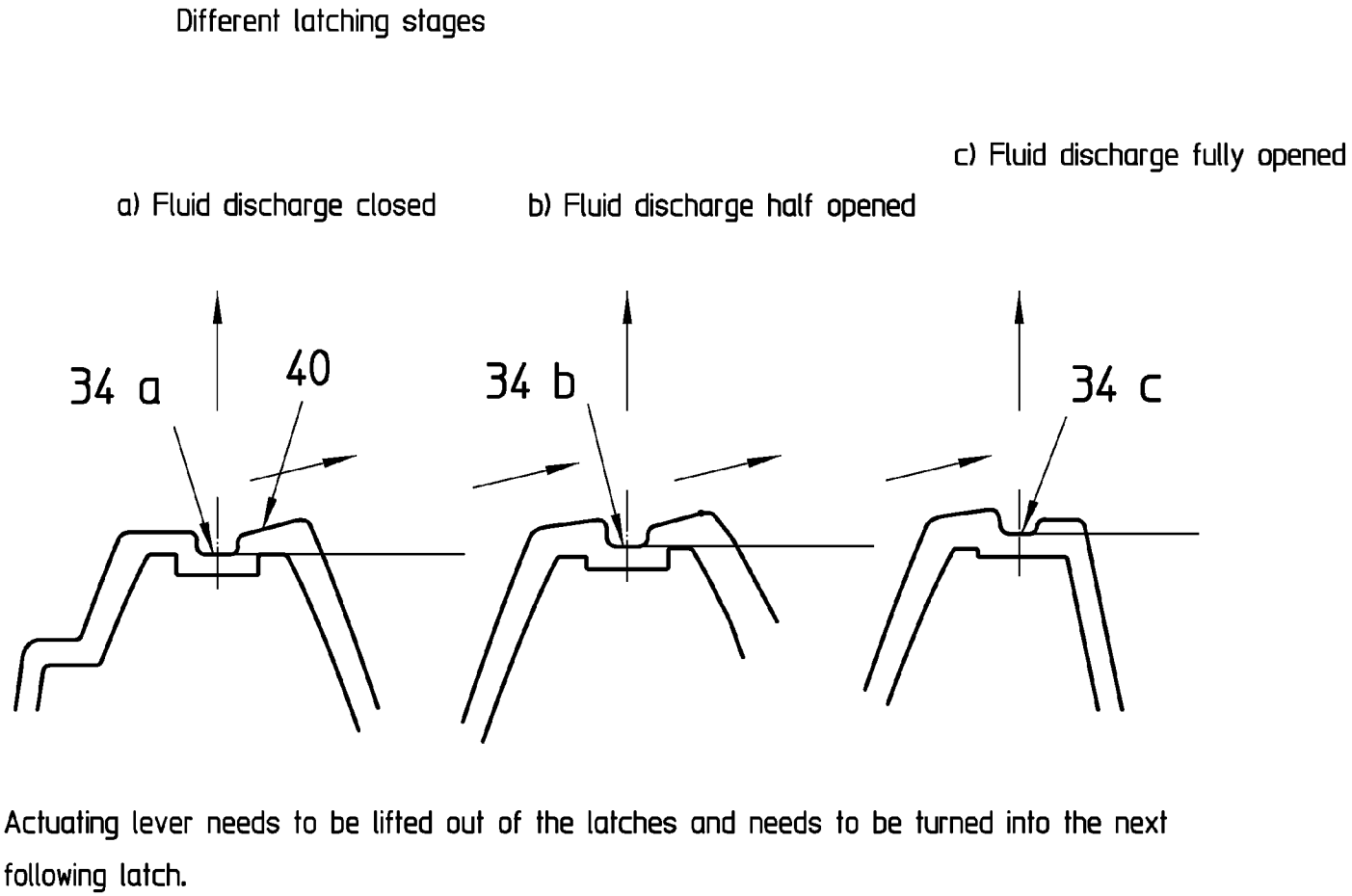
FIG. 10 explains an exemplary embodiment of different latching steps.

FIG. 9 shows a top view of the control lever 5 and different latching positions 34*a*, 34*b* and 34*c* for the swivel lever 5. The rotational axis about which the swivel lever 5 can be moved protrudes in the illustration of FIG. 9 out of the drawing plane in a perpendicular manner. In order to bring the control lever 5 from one latching position to a further latching position it is necessary to lift the control lever somewhat at first (moving in FIG. 9 from the plane of the drawing in the direction towards the spectator). A rotational movement is only then possible and no longer obstructed by a latching position or latching in the same. The latching positions 34*a*, 34*b* and 34*c* shown in FIG. 9 have different depths, so that the control lever needs to be lifted out of the fluid tank 2 to a differently far extent. This is also shown in FIG. 10 in detail. Three different latching stages are provided in the illustrated embodiment. The fluid discharge is closed in latching stage 34*a*. The fluid discharge is half opened in latching stage 34*b*. The fluid discharge is fully opened in the latching stage 34*c*.

The various latching stages are shown in the example as shown in FIG. 10 by various recesses. In comparison with the adjacent surface of the bracket or the fluid tank, they are provided with a configuration which is approximately of the same depth, but the floor of the respective recess is located at different levels, so that the control lever is pulled out differently far from the fluid tank when latched in each of these positions. The different level of the floor of the recesses is indicated in FIG. 10 by the horizontal lines which are located at different levels. Regions are provided between the latching positions 34*a*, 34*b*, and 34*c* which have a beveled portion 40. When the swivel lever 5 is operated, it is moved from one latching position to the next along the direction of the lower incline (indicated by arrows in FIG. 10) over the beveled portions 40. This enables a guided twisting of the swivel lever 5. It is also possible that securing mechanisms are built into the latching stages of "fluid discharge closed" and/or "fluid discharge completely opened", which securing mechanisms only allow a motion or twisting of the swivel lever 5 in only one direction. This prevents a direct transition for example between the position of "fluid discharge closed" and "fluid discharge completely opened", which, if so desired, creates additional operational security for a user of the sprinkler apparatus in accordance with the invention.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A sprinkler apparatus for dosed sprinkling of a base plate of a vibration apparatus for soil compaction, comprising:

a water tank with a fluid outlet;

a valve for controlling the fluid released by the fluid outlet, the valve comprising a conical nipple arranged inside the water tank and a valve insert configured to be inserted from outside the tank and attached on a wall of the tank;

a tensioning means arranged inside the water tank for holding the conical nipple against the valve insert under a pretension;

a control lever for actuating the valve, the control lever being arranged outside of the water tank on an upper region of the water tank; and an actuating rod that extends through the water tank, wherein the actuating rod connects the conical nipple with the control lever so that the position of the conical nipple is changed relative to the valve insert under actuation of the control lever.

2. A sprinkler apparatus according to claim 1, wherein the control lever is attached outside on the upper region of the water tank.

3. A sprinkler apparatus according to claim 1, wherein the control lever is a swivel lever which rests on a bracket with at least two different latching positions, into which the swivel lever can be brought by turning, so that the position of the conical nipple can be changed depending on the position of the swivel lever in one of the latching positions via an actuating element which is connected with the swivel lever.

4. A sprinkler apparatus according to claim 3, wherein the latching positions are arranged in the form of recesses in the bracket in such a way that the swivel lever needs to be lifted for turning to a different latching position.

5. A sprinkler apparatus according to claim 3, wherein twisting of the swivel lever occurs about an axis of the actuating element.

6. A sprinkler apparatus according to claim 3, wherein a connecting area between the latching stages comprises a beveled portion.

7. A sprinkler apparatus according to claim 1, comprising a sprinkler tube configured to be pressed into the valve insert.

8. A sprinkler apparatus according to claim 1, wherein the sprinkler apparatus is detachably fastened to a vibration apparatus.

9. A sprinkler apparatus according to claim 1, wherein the water tank of the sprinkler apparatus comprises a depression for receiving a motor hoop guard of a vibration apparatus, so that the sprinkler apparatus can be placed on the vibration apparatus.

10. A vibration apparatus for soil compaction, comprising:

an exciter for generating vibrations;

a base plate which can be made to vibrate by the exciter, and sprinkler apparatus according to claim 1.

11. A sprinkler apparatus for dosed sprinkling of a base plate of a vibration apparatus for soil compaction, comprising:

a water tank with a fluid outlet;

a valve to control the fluid released by the fluid outlet, the valve comprising a moving portion arranged inside the water tank and a valve insert configured to be inserted from outside the tank and attached on a wall of the tank;

a tension mechanism configured to hold the moving portion against the valve insert;

a control lever to actuate the valve, the control lever being arranged outside of the water tank on an upper region of the water tank; and an actuating rod that extends through the water tank, wherein the actuating rod connects the moving portion with the control lever so that the position of the moving portion is changed relative to the valve insert under actuation of the control lever.

12. A sprinkler apparatus according to claim 11, wherein the control lever is attached outside on the upper region of the water tank.

13. A sprinkler apparatus according to claim 11, wherein the control lever is a swivel lever which rests on a bracket with at least two different latching positions, into which the swivel lever can be brought by turning, so that the position of the moving portion can be changed depending on the position of the swivel lever in one of the latching positions via an actuating element which is connected with the swivel lever.

14. A sprinkler apparatus according to claim 13, wherein the latching positions are arranged in the form of recesses in the bracket in such a way that the swivel lever needs to be lifted for turning to a different latching position.

15. A sprinkler apparatus according to claim 13, wherein twisting of the swivel lever occurs about an axis of the actuating element.

16. A sprinkler apparatus according to claim 13, wherein a connecting area between latching stages comprises a beveled portion.

17. A vibration apparatus for soil compaction, comprising:

an exciter for generating vibrations;

a base plate which can be made to vibrate by the exciter, and a sprinkler apparatus according to claim 11.

* * * * *